United States Patent [19]

Reichard

[11] 4,034,699

[45] July 12, 1977

[54] DEVICE FOR HOUSEBREAKING A DOG

[76] Inventor: Earl E. Reichard, 1813 John Ave., Superior, Wis. 54880

[21] Appl. No.: 634,542

[22] Filed: Nov. 24, 1975

[51] Int. Cl.$^2$ ..... G10K 1/07

[52] U.S. Cl. ..... 116/150; 116/170

[58] Field of Search ..... 116/150, 170, 172, 148, 116/171

[56] References Cited

U.S. PATENT DOCUMENTS

| | | | |
|---|---|---|---|
| 148,084 | 3/1874 | Pattison | 116/150 |
| 532,635 | 1/1895 | Borneisen | 116/150 |
| 1,557,769 | 10/1925 | Palmore | 116/150 |
| 1,575,754 | 3/1926 | Gill | 116/150 |
| 2,655,122 | 10/1953 | Adams | 116/172 |

*Primary Examiner*—S. Clement Swisher
*Assistant Examiner*—Denis E. Corr
*Attorney, Agent, or Firm*—Wicks & Nemer

[57] ABSTRACT

A device for animals to signal aid which includes a flat base member on which is mounted a hanger arm which overlies the base. A bell mount is pivotally mounted on the outer free end of the arm with a clapper bell secured thereto and an activator pad is secured to the bell mount obliquely disposed to the vertical when the base is horizontal. The activator pad is of a color which is lighter with respect to the color of the base and hanger arm so that it makes it prominent and easy for the animal to identify. When the activator pad is pivotally depressed the bell is caused to ring.

1 Claim, 5 Drawing Figures

FIG. 1
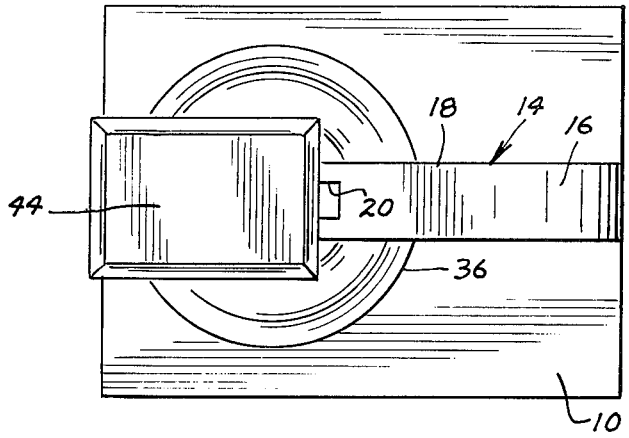
FIG. 2
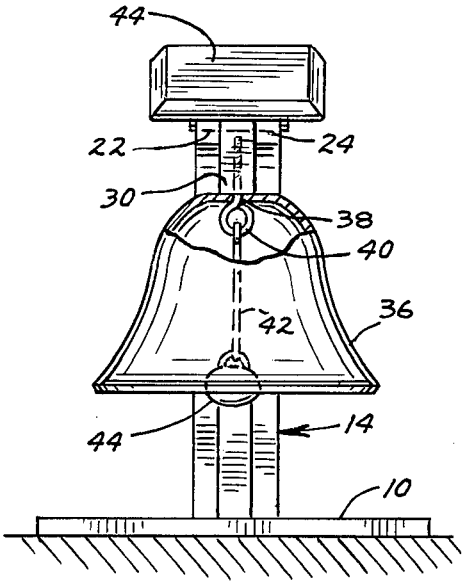
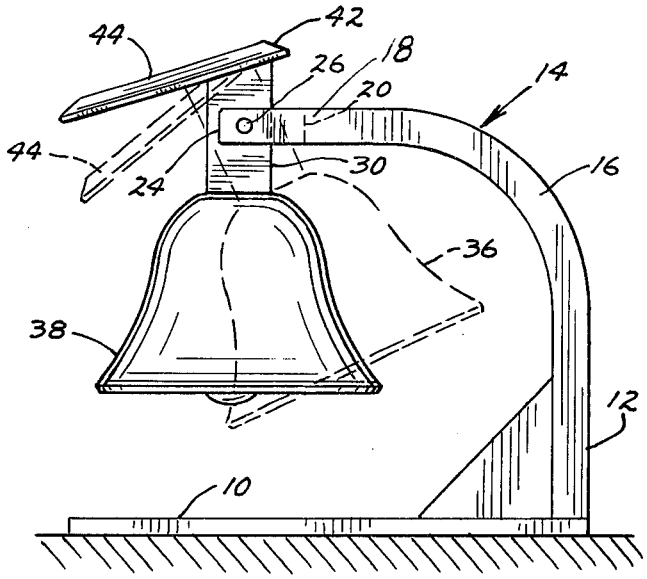
FIG. 3
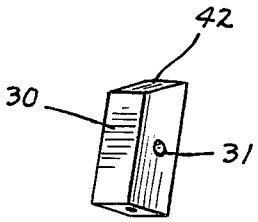
FIG. 5
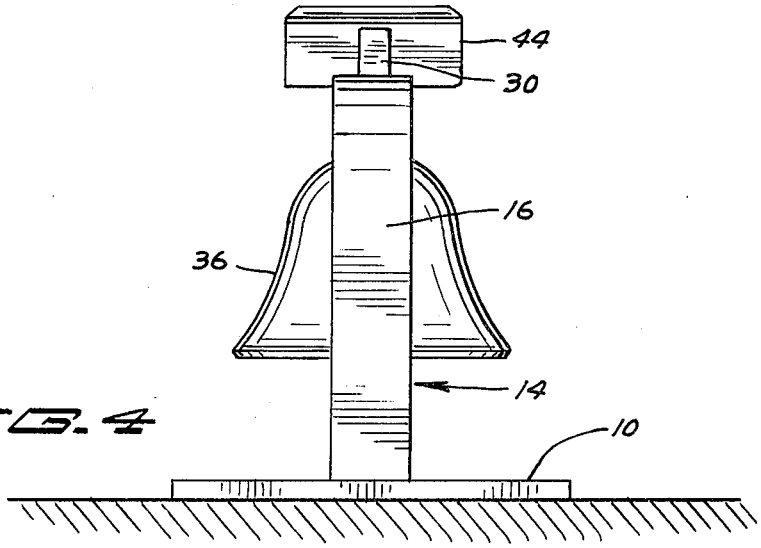
FIG. 4

DEVICE FOR HOUSEBREAKING A DOG

SUMMARY

The invention relates to an improvement in a device for animals to signal for aid for use in "house breaking" a dog, for example. The device includes a base on which is mounted an arm on which a bell is pivotally mounted. It is an object of the invention to provide a bell mount which has thereon an activator pad obliquely disposed to the vertical which allows for easy application and release of a dog's paw to and from the pad thereby not confusing the dog. It is a further object of the invention to provide the pad with a white or light coloring and the base with a dark color to aid the dog in recognizing the pad. In using the device, the same is placed on the floor near an exit door and a dog is led by the owner to the device. The dog's paw is held by the owner and pushed down upon the activator pad thereby ringing the bell. The dog owner then immediately opens the door and lets the dog go outside to meet his needs. Thus, a dog learns that it can get outside by pushing down on the pad and ringing the bell which in turn brings about the opening of the door.

The invention will appear more clearly from the following detailed description when taken in connection with the accompanying drawings, showing by way of example a preferred embodiment of the invention idea wherein like numerals refer to like parts throughout:

In the drawings forming part of this application:

FIG. 1 is a top plan view of a device for animals to signal aid embodying the invention.

FIG. 2 is a front end view thereof with a portion thereof broken away.

FIG. 3 is a side elevational view.

FIG. 4 is a rear end view.

FIG. 5 is a perspective view of the pivotal bell mount.

Referring to the drawings in detail, the device A includes the flat base plate 10. Connected to the base plate 10 at one end thereof is the straight lower end portion 12 of the hanger arm 14. The hanger arm 14 includes the lower end 12 terminating in the arcuate portion 16 which in turn terminates in the upper straight end portion 18. The length of the hanger arm 14 is such that the outer end of the portion 18 overlies the base plate 10, and the lower end 12 of the arm is secured centrally of the end of the plate 10.

The outer end of the arm 14 is recessed as at 20 thereby forming a bifurcated end with the two spaced ears 22 and 24. Mounted in and extending between the ears 22 and 24 is the pivot pin 26.

The numeral 28 designates a bell mount base 30 which may be formed of plastic and which has a hole 31 therethrough and through which the pin 26 extends to thereby pivotally mount the base 30 on the ears 22 and 24. Formed in the top 34 of the bell is the hole 38. An eye screw 40 is positioned through the hole 38 of the bell and screwed into the mount base 30 thereby securing the bell to the mount base with the eye screw extended within the bell.

The bell mount base 30 has formed on the upper end thereof the end 42 which is disposed at an oblique angle to the sides and longitudinal axis of the mount base, and secured to the end 42 is the pad 44 so that it extends outwardly from the mount base 30 and downwardly relative to the vertical and with the pad disposed at an angle there is less accuracy required to depress and release the same and too much accuracy cannot be required of a dog, for example, in applying his paw to the pad. As a further result of the angular disposition of the pad, the pad swings away from the paw of the animal so that the paw of the animal easily slips from the pad. As a result the animal is not confused. Secured to the eye 40 is the hanger 42, and the other end of the hanger is secured to the clapper 44. Thus when the pad 44 is depressed the mount 30 is pivoted thereby ringing the bell. The pad is preferrably colored white or light pastel coloring with the rest of the device of a much darker contrasting color and with such a coloring of the device the dog is attracted and directed to the pad.

In using the device A in connection with the house breaking of a dog, the device is placed on the floor and near an exit door that leads to the outside. The dog is led by the owner to the device. The dog's paw is held by the owner and pushed down upon the pad 44 whereby the mount 30 and bell thereon are pivotally moved thereby ringing the bell 38. The owner then immediately opens the door and lets the dog go outside to meet his needs. As a result the dog learns that it can get outside by pushing down on the pad 44 which rings the bell which in turn brings about the desired opening of the door.

Having thus described the invention, what is claimed as new and desired to be secured by Letters Patent Is:

1. A device for animals to signal aid comprising:

a. a support means, b. a curved hanger arm having one end secured to said support means adjacent the edge of the support means with the free end of the hanger arm overlying said support means, c. a bell mount d. means pivotally mounting said bell mount on the free end of said hanger arm, e. a clapper bell mounted on the lower end of said bell mount, f. an activator pad mounted on the upper end of and extending obliquely from said bell mount and in line with said hanger which when depressed pivots the bell mount and causes the bell to ring, g. said means pivotally mounting said bell mount on said hanger arm including the free end of said hanger arm being bifurcated with said bell mount pivotally mounted in the bifurcation by means of a pin thereby allowing the activator pad to pivot about said pin.

* * * * *